US005210986A

United States Patent [19]

Hagemeyer et al.

[11] Patent Number: 5,210,986

[45] Date of Patent: May 18, 1993

[54] WINDOW UNIT NAILING FIN AND CORNER LOCK

[75] Inventors: Bruce A. Hagemeyer, Pella; Mearl Minter, Oskaloosa; Merlan J. Rolffs; Jay T. Scripter, both of Pella, all of Iowa

[73] Assignee: Rolscreen Company, Pella, Iowa

[21] Appl. No.: 650,232

[22] Filed: Feb. 4, 1991

[51] Int. Cl.[5] ..... E06B 1/04

[52] U.S. Cl. ..... 52/211; 52/213; 52/212; 52/214; 49/501; 49/504

[58] Field of Search ..... 52/211, 212, 213, 214, 52/206, 216; 49/501, 504

[56] References Cited

U.S. PATENT DOCUMENTS

| | | | |
|---|---|---|---|
| 2,863,534 | 12/1958 | Gillespie | 52/212 |
| 3,259,086 | 7/1966 | Stein . | |
| 3,402,512 | 9/1968 | Peterson . | |
| 3,473,266 | 10/1969 | Miller . | |
| 3,694,961 | 10/1972 | Johnson . | |
| 4,122,633 | 10/1978 | Holdiman . | |
| 4,207,707 | 6/1980 | Holdiman . | |
| 4,237,664 | 12/1980 | Wilmes . | |
| 4,578,905 | 4/1986 | Hout . | |
| 4,821,472 | 4/1989 | Tix | 52/213 |
| 4,999,957 | 3/1991 | Kessler | 52/213 |

*Primary Examiner*—Richard E. Chilcot, Jr.
*Assistant Examiner*—Wynn E. Wood
*Attorney, Agent, or Firm*—Zarley, McKee, Thomte, Voorhees & Sease

[57] ABSTRACT

A one-piece metal frame fin is locked to the wooden frame members of a window unit by exterior cladding. A notch in the frame members receives the inner portion of the nailing fin while the outer portion of the fin is recessed into the wood when the fin is in its closed position for storage, transport and use in abutting frame members of multiple window units. An L-shaped corner nailing fin is carried on one of the frame fins and can be pivoted into locking engagement with the adjacent frame fin during installation of the window unit. In the case of joined multiple window units a mullion cover extends over the adjacent ends of the frame nailing fins and is locked to the outer nose portion of the exterior cladding. Use of foam sealing strips eliminates the need for on the job site caulking.

48 Claims, 5 Drawing Sheets

WINDOW UNIT NAILING FIN AND CORNER LOCK

BACKGROUND OF THE INVENTION

Representative prior art involving window or door units having nailing fins is illustrated in patent 4,578,905, Apr. 1, 1986 and in FIG. 17 of this application. These fins have a bead received in a groove formed in an extruded extension member of the window frame. The fin when in a closed position lies flat against the outer face of the frame member and is nailed in place to hold it until it is used at window installation time when the fin is then pivoted to an open position perpendicular to the plane of the window unit. This arrangement requires extruding a costly groove in the frame extension member and the fins are exposed during shipment resulting in possible damage to them. At installation time a nail has to be removed to allow them to pivot. If window units are in side by side abutting relationship, the fins have to be removed otherwise the windows are spaced apart by the thickness of the fins.

The nailing fin and corner lock of this invention overcome these problems.

SUMMARY OF THE INVENTION

A metal, one-piece frame fin extends along the exterior wooden frame members of a window unit with an inner portion received in a groove in the wood frame and is overlaid by exterior metal cladding. The free end portion of the fin is received in a recess formed in the frame member where the fin is maintained during storage and shipment and in the case of multiple windows installed in abutting relationship. The recess is larger than the fin to allow a person's fingers to be placed under the fin to bend it to an open position in the plane of the window. A series of openings are formed at the juncture of the first and second fin portions to establish a fold line and for ease of folding. The inherent strength of the metal will keep the fin in both its open and closed positions. Sealing material is placed over the openings to seal the fin against seepage of moisture therethrough.

The fins extend along each frame member to the corners of the window unit where a separate L-shaped corner fin interlocks the adjacent fins. Outwardly opening slots are provided in the frame fins which also open into elongated slots in the frame fins in which a pin on the corner fin is received. The pin has an enlarged head for holding the pins in the elongated openings. The size of the pin is greater than the maximum width of the slot and thus the pins snap into elongated openings when moved from the slots. This allows for adjustment to correct any misalignment problems.

Sealing strips are provided between abutting frame members and on a mullion cover which extends between adjacent frame fins in an open position on a multiple window unit. The mullion cover has a return bend on the forward edge which snaps over the nose on the front face of the frame members. Caulking is substantially reduced or eliminated through the use of the adhesively secured sealing strips which contain foam material.

DESCRIPTION OF THE PREFERRED EMBODIMENT

Figure 1:
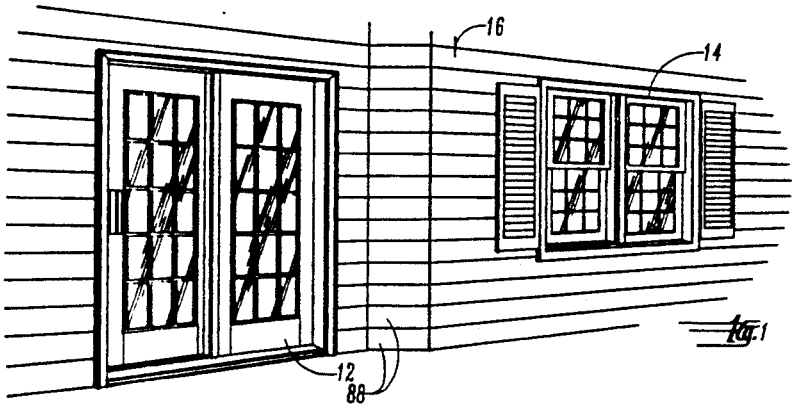
FIG. 1 is a fragmentary perspective view of window and door units utilizing the nailing fin and corner lock of this invention.
Figure 2:
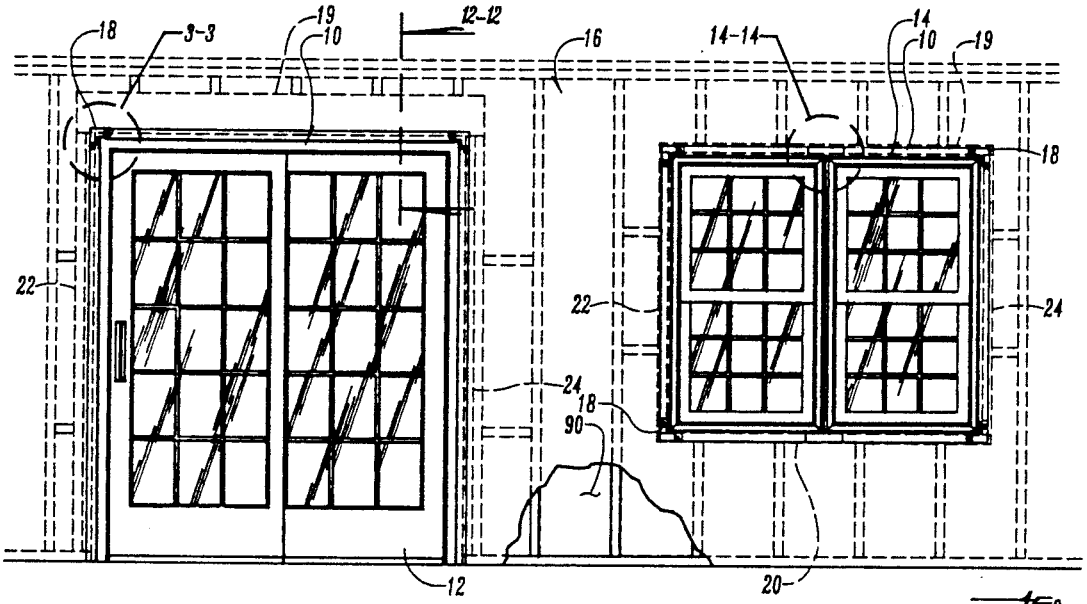
FIG. 2 is an enlarged fragmentary front elevational view thereof.
Figure 5:
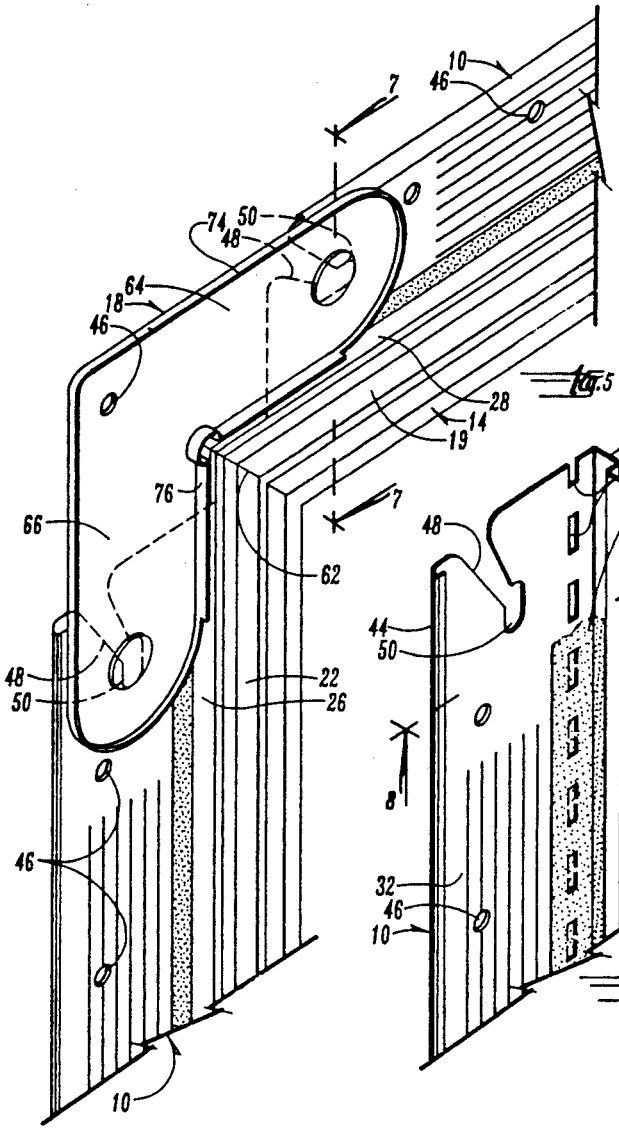
FIG. 5 is an enlarged fragmentary perspective view of the corner fin in use as seen in FIG. 4.
Figure 6:
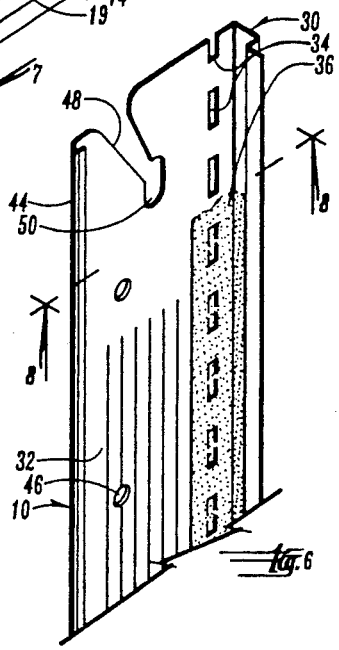
FIG. 6 is an enlarged fragmentary perspective view of the window frame member locking fin.

The nailing fin of this invention is referred to generally by the reference numeral 10 in FIG. 6 and is shown in use in the side-by-side doors 12 and side-by-side window units 14 in a wall 16 in FIG. 1. As seen in FIG. 5, a corner lock fin 18 interconnects the adjacent fins 10.

Figure 3:
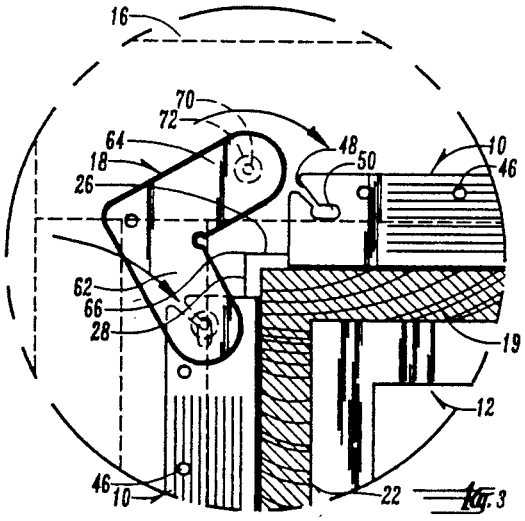
FIG. 3 is an enlarged fragmentary view of the corner fin as indicated along line 3—3 in FIG. 2.

Each of the window units 14 includes a frame comprising a top frame member 19, a bottom frame member 20 and opposite side frame members 22 and 24. Each of the frame members include an outer face representative of which is face 26 on frame member 19 as seen in FIG. 3 and a front face 28.

Figure 7:
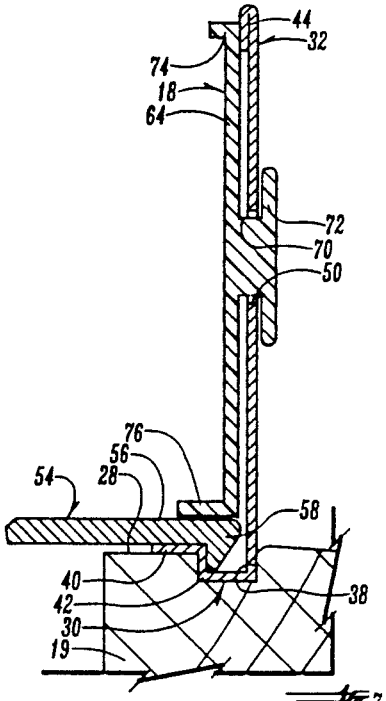
FIG. 7 is a cross sectional view taken along lines 7—7 in FIG. 5.
Figure 8:
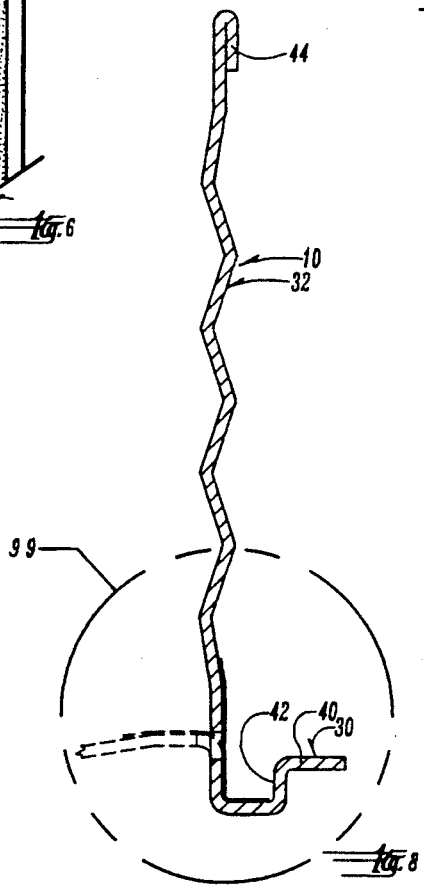
FIG. 8 is a cross sectional view taken along line 8—8 in FIG. 6.

The nailing frame fin 10 as seen in FIG. 6 includes an inner portion 30 and an outer portion 32. The portions 30 and 32 are pivotally interconnected along a fold line established by a series of openings 34 covered by a strip of sealing material 36 adhesively held in place over the openings to restrict the passage of moisture therethrough. The inner portion 30 is shaped to matingly conform to a notch 38 formed in the wooden frame member 19 as seen in FIG. 7. The inner fin portion 30 thus includes a leg 40 which merges into a channel portion 42 which in turn is connected to the outer fin portion 32. The outer free end of the outer fin portion 32 has a return bend 44 as seen in FIG. 6 for strengthening the fin 10. Nailing holes 46 are provided along the length of the fin.

An elongated diagonally extending slot 43 extends in from the free end and connects with an elongated opening 50 oriented with its longitudinal axis parallel to the longitudinal axis of the fin 10.

Figure 10:
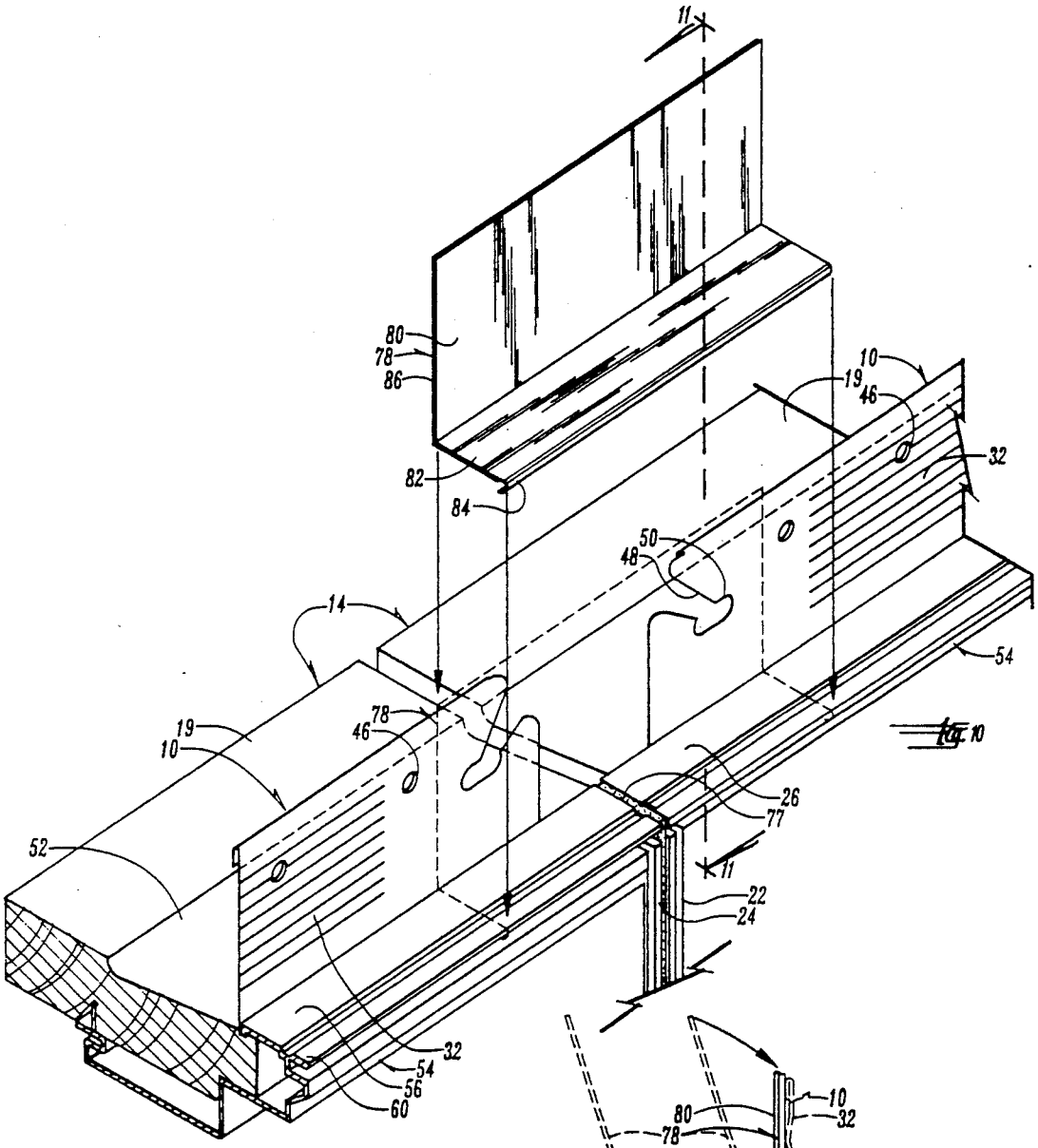
FIG. 10 is a fragmentary perspective view of window units in side-by-side relationship utilizing a mullion cover to interconnect adjacent fins.
Figure 12:
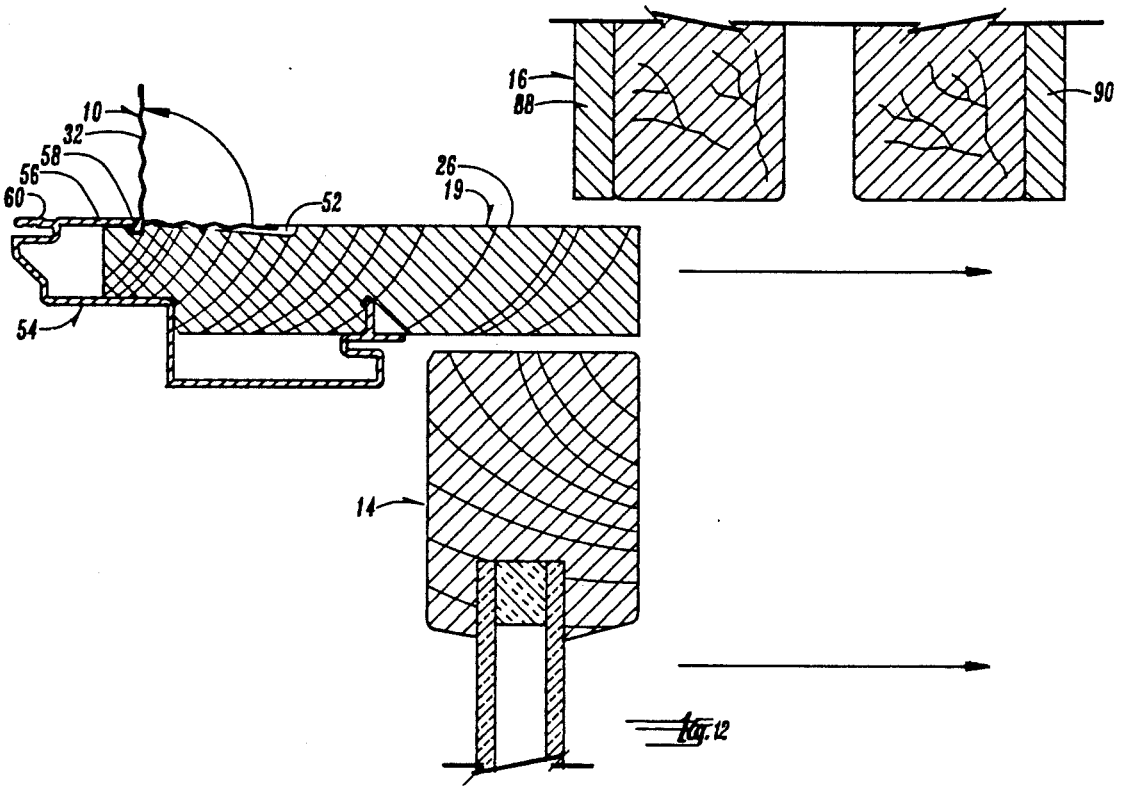
FIG. 12 is a cross sectional view taken along line 12—12 in FIG. 2 showing the installation of the window unit in a frame opening.
Figure 16:
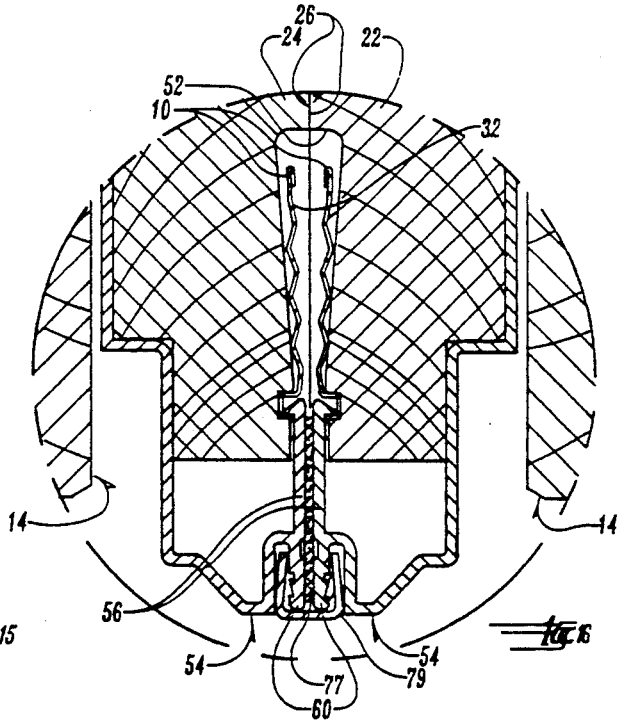
FIG. 16 is an enlarged detail view as indicated by line 16—16 in FIG. 15.
Figure 17:
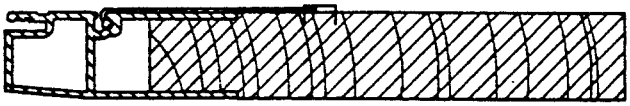
Fig. 17 (PRIOR ART)
FIG. 17 is a cross sectional view of a window frame member having a nailing fin which is representative of the prior art.

As seen in FIG. 10 the window frame member 19 includes a recessed area 52 which receives the portion 32 of the fin 10 when in its closed position for storage and shipment and on abutting frame members of multiple window units. As seen in FIG. 16 the finger recesses 52 are larger than the fin portions 32 to allow fingers to be placed under the fin portions to bend them from a closed position to an open position as seen in FIG. 12. It is also seen in FIG. 12 that the fin 10 when in its closed position in the recess 52 is below the outer face 26 of the frame member 19 and is held there by the inherent strength of the metal material.

Figure 9:
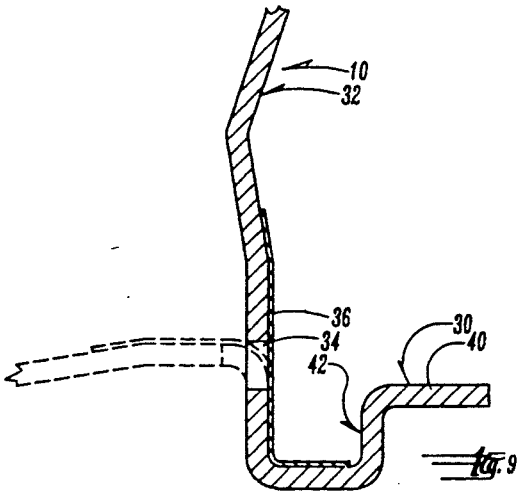
FIG. 9 is an enlarged detail view as indicated by the line 9—9 in FIG. 8.

Frame members such as frame member 19 in FIG. 12 include cladding 54 having a leg 56 with an inwardly turned leg 58 received in the U-shaped portion 42 (FIG. 9) of the fin which in turn is received in the notch 38 (FIG. 7) in the wood frame member 19. This locks the fin 10 solidly to the frame member 19. The cladding 54 portion 56 includes an outer nose portion 60 which will be discussed hereinafter. Although not shown in the drawings, the fins 10 could be folded outwardly into a recess in the cladding 54.

Figure 4:
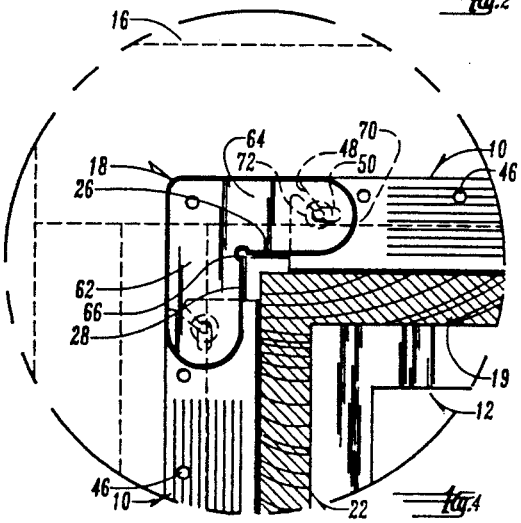
FIG. 4 is a view similar to FIG. 3 but showing the corner fin in the locked position.

The frame fins 10 extend to adjacent the corners of the window frame member such as corner 62 in FIG. 4. A gap then exists between the adjacent ends of the adjacent fins. The corner fin 18 then closes the gap around the corner 62. Corner fin 18 is L-shaped and includes leg portions 64 and 66. Each leg carries a pin 70 as seen in FIG. 7 with a head 72. The pin 70 is received in the slot 48 and is slightly wider in diameter than the slot thus allowing it to snap into the elongated opening 50. The corner fin 18 is then free to move longitudinally of the fins 10 to allow for mating engagement with the corner of the window unit and to correct any misalignment problems.

The corner fin 18 also includes an outer perpendicular flange 74 and an inner flange 76 for strength and sealing purposes. It is seen that one of the fins on one of the frame members such as frame member 22 in FIG. 3 carries the corner fin 18 while in storage and shipment and then when the window unit is being installed and the fin 10 has been pivoted outwardly to the open position the corner fin 18 is rotated to it: connecting position with the adjacent fin 10 as seen in FIG. 4.

Figure 15:
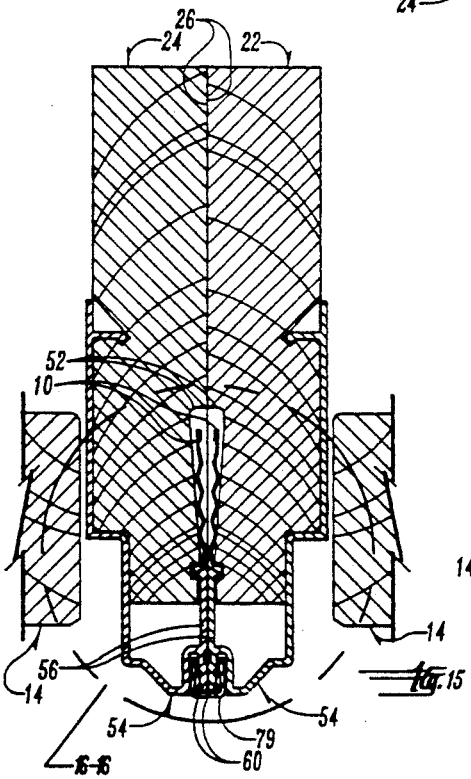
FIG. 15 is a cross sectional view taken along line 15—15 in FIG. 14.

In FIG. 10 a pair of window units 14 are seen in side-by-side abutting relationship and as previously discussed the fins 10 remain in their recesses 52 in the abutting frame members as they are not required for their installation. A strip of foam sealing material 77 is adhesively applied to the outer faces of the frame members to seal the opening between the frame members which are in direct abutting contact as seen in FIGS. 15 and 16. A metal clip 79 innerconnects the nose portions 60 of the cladding 54.

Figure 11:
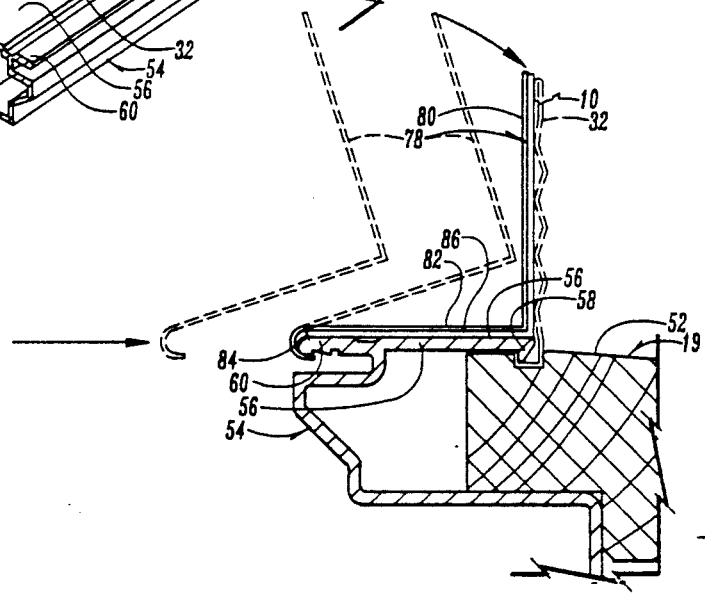
FIG. 11 is a cross sectional view taken along line 11—11 in FIG. 10.

A mullion cover 78 is placed over the adjacent ends of the fins 10 as seen in FIGS. 10 and 11. The mullion cover 78 is L-shaped including an outer leg 80 innerconnected to an inner leg 82 having a return bend portion 84 for snapping onto the cladding nose portion 60. The mullion cover 78 includes on its backside adhesively secured sealing foam 86 which provides a dry seal at the juncture of the two window units and ends of both fins 10.

Figure 13:
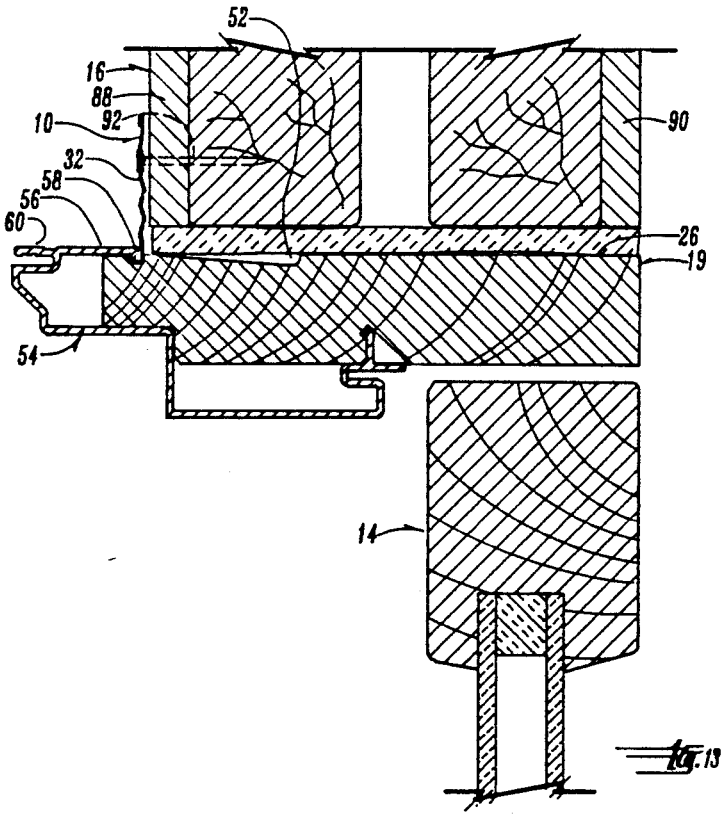
FIG. 13 is a view similar to FIG. 12 but showing the window unit in its installed position.
Figure 14:
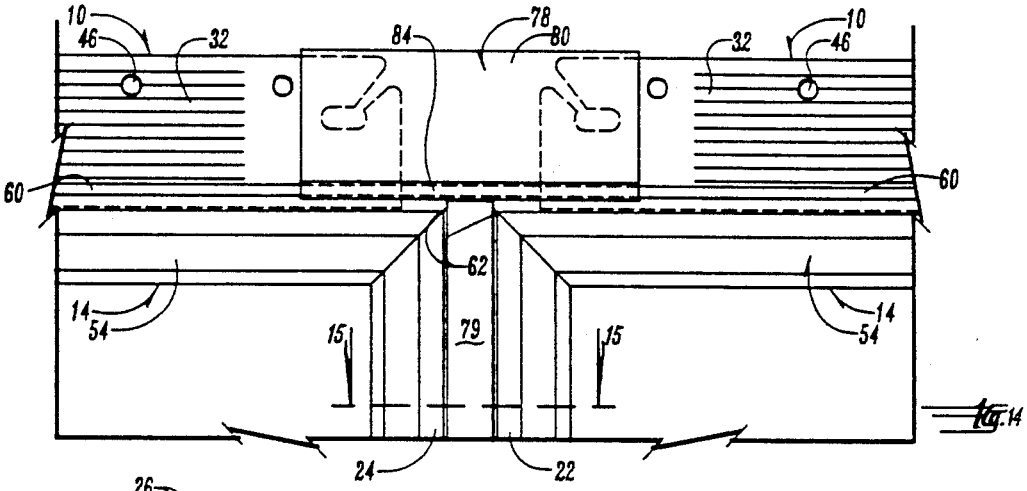
FIG. 14 is an enlarged fragmentary detail view as is indicated by line 14—14 in FIG. 2.

In FIGS. 12 and 13 the steps of installing the window units in a wall opening are illustrated. The wall 16 includes outside sheathing 88 and an interior wallboard 90. After the window unit 14 is in position or is ready to be put into the wall opening, the outer fin portion 32 is pivoted to its open position and then the window unit is moved to the right into the window opening where the fin 10 is nailed to the outside siding 88 and interior studs by nail 92. It is thus seen that mass production of window-door units is possible utilizing two basic fins, i.e., frame fins 10 and corner fins 18. If window units are put in side-by-side relationship, the mullion cover 78 is utilized to close the gap at the corners between the frame fins 10 on adjacent windows. The corner fins 18 close the gap at the corners between adjacent frame fins 10. The use of dry sealing material as appropriate eliminates the need for on the site caulking.

I claim:

1. A window unit adapted to be mounted in an opening in a wall of a building, comprising, a window unit in a plane having a frame including top and opposite side members, each of said members having an outside face perpendicular to said plane and a front face parallel to said plane, a frame fin in a closed position extending along the outside face of each of said members pivotable to an open position, attachment means for securing said frame fins to each of said members, and the outside face of each member having a recess in which said frame fin is received when in said closed position, said frame fins in said closed position being in a plane inwardly of and parallel to the outside faces of said members.

2. The structure of claim 1 wherein said recess is larger than said fin to provide a finger recess for gripping said fin to pivot it to said open position.

3. The structure of claim 2 wherein said recesses and fins have substantially complementary shapes with the exception of said recess being longer than said fin whereby said finger recess is located at an outer end of said fin.

4. The structure of claim 1 wherein said fins include outer and inner portions with said inner portions being secured by said attachment means to said members.

5. The structure of claim 4 wherein said fins include a series of openings positioned along said attachment means for facilitating bending said fins when being pivoted between closed and open positions.

6. The structure of claim 5 wherein a strip of sealing material is positioned over said series of openings to prevent passage of moisture through said fins.

7. The structure of claim 4 wherein said attachment means includes said members including elongated notches in which said inner portions are received.

8. The structure of claim 7 wherein said members are wooden and non wooden cladding is provided on said members and include portions which overlie said inner portions of said fins in said notches to lock said fins in said notches.

9. The structure of claim 8 wherein said fins and cladding are made of metal.

10. The structure of claim 1 wherein said fins are made of metal.

11. The structure of claim 10 wherein said fins include longitudinally extending corrugations to strengthen said fins.

12. The structure of claim 1 wherein said fins include outer edges which have return bend portions.

13. The structure of claim 1 wherein said window unit includes corners and said frame fins extend along said members to said corners, and corner fins are provided for interconnecting adjacent frame fins at said corners.

14. The structure of claim 13 wherein said corner fins are L-shaped with legs adapted to overlap the adjacent ends of said frame fins in said open position at said corners.

15. The structure of claim 14 wherein said frame fins and corner fins include cooperating lock means.

16. The structure of claim 15 wherein said cooperating lock means includes said frame fins having outwardly opening slots for receiving a corner fin pin, said pin having a head spaced from said corner fin, said head being larger than said slot for locking said corner fin in place.

17. The structure of claim 16 wherein said frame fins include elongated openings extending parallel to the longitudinal axes of said frame fins and being connected to said slots receiving said pins whereby said corner fins are adjustable to matingly engage said corners of said window units.

18. The structure of claim 1 wherein a pair of window units are positioned in side by side relationship with adjacent members operatively abutting each other and said frame fins thereon being positioned in said recesses in said closed position.

19. The structure of claim 18 wherein a strip of sealing material is adhesively positioned between said abutting members.

20. The structure of claim 19 wherein fastening means are provided on the front faces of said members which operatively engage adjacent members to lock them together.

21. The structure of claim 20 wherein said strip of adhesively secured sealing material is positioned between adjacent outside faces of said members.

22. The structure of claim 18 wherein a mullion cover is positioned over adjacent ends of said frame fins on adjacent window units when said frame fins are in said open position.

23. The structure of claim 22 wherein said mullion cover is L-shaped and includes a first leg extending over the adjacent ends of said adjacent frame fins and a second leg extending over the outside faces of said members.

24. The structure of claim 23 wherein locking means are provided for securing said mullion cover to said window unit which includes adhesive between said first leg and said adjacent ends of said frame fins.

25. The structure of claim 24 wherein said locking means further includes said mullion cover having a forward portion shaped to operatively snap over the front faces of said adjacent members.

26. The structure of claim 25 wherein said forward portion of said mullion cover is U-shaped.

27. The structure of claim 17 wherein said pins have a size larger than the width of said slots and said frame fins are made of flexible material whereby said pins are snapped into said elongated openings from said connecting slots.

28. A window unit adapted to be mounted in an opening in a wall of a building, comprising, a window unit in a plane having a frame including top and opposite side members, each of said members having an outside face perpendicular to said plane and a front face parallel to said plane, a frame pin in a closed position extending along the outside face of each of said members and having inner and outer portions with said outer portion being bendable to an open position, said frame fins being made from a material which will yieldably maintain said frame fins alternately in said open and closed positions, and attachment means for securing the inner portion of said frame fins to each of said members.

29. A window unit adapted to be mounted in an opening in a wall of a building, comprising, a window unit in a plane having a frame including top and opposite side members, each of said members having an outside face perpendicular to said plane and a front face parallel to said plane, a frame fin in a closed position extending along the outside face of each of said members and having inner and outer portions with said outer portion being bendable to an open position, said frame fins being made from a material which will yieldably maintain said frame fins alternately in said open and closed positions, attachment means for securing the inner portion of said frame fins to each of said members, and said fins including a series of openings positioned along said attachment means for facilitating bending said fins when being pivoted between closed and open positions.

30. The structure of claim 29 wherein a strip of sealing material is positioned over said series of openings to prevent passage of moisture through said fins.

31. The structure of claim 29 wherein said attachment means includes said members including elongated notches in which said inner portions are received.

32. The structure of claim 31 wherein said members are wooden and non wooden cladding is provided on said members and include portions which overlie said inner portions cf said fins in said notches to lock said fins in said notches.

33. The structure of claim 32 wherein said fins and cladding are made of metal.

34. The structure of claim 29 wherein said fins are made of metal.

35. The structure of claim 29 wherein said fins include longitudinally extending corrugations to strengthen said fins.

36. A window adapted to be mounted in an opening in a wall of a building, comprising, a window unit in a plane having a frame including top and opposite side members, each of said members having an outside face perpendicular to said plane and a front face parallel to said plane, a frame fin in a closed position extending along the outside face of each of said members and having inner and outer portions with said outer portion being bendable to an open position, said frame fins being made from a material which will yieldably maintain said frame fins alternately in said open and closed positions, attachment means for securing the inner portion of said frame fins to each of said members, and said window unit including corners and said frame fins extending along said members to said corners, and corner fins being provided for interconnecting adjacent frame fins at said corners.

37. The structure of claim 36 wherein said corner fins are L-shaped with legs adapted to overlap the adjacent ends of said frame fins in said open position at said corners.

38. The structure of claim 37 wherein said frame fins and corner fins include cooperating lock means.

39. The structure of claim 38 wherein said cooperating lock means includes said frame fins having outwardly opening slots for receiving a corner fin pin, said pin having a head spaced from said corner fin, said head being larger than said slot for locking said corner fin in place.

40. The structure of claim 39 wherein said corner fins include elongated openings extending parallel to the longitudinal axes of said frame fins and being connected to said slots receiving said pins whereby said corner fins are adjustable to matingly engage said corners of said window units.

41. A window unit adapted to be mounted in an opening in a wall of a building, comprising, a window unit in a plane having a frame including top and opposite side members, each of said members having an outside face perpendicular to said plane and a front face parallel to said plane, a frame fin in a closed position extending along the outside face of each of said members pivotable to an open position, attachment means for securing said frame fins to each of said members, and said window unit including corners and said frame fins extending along said members to said corners, and corner fins being provided for interconnecting adjacent frame fins at said corners.

42. The structure of claim 41 wherein said corner fins are L-shaped with legs adapted to overlap the adjacent ends of said frame fins in said open position at said corners.

43. The structure of claim 42 wherein said frame fins and corner fins include cooperating lock means.

44. The structure of claim 43 wherein said cooperating lock means includes said frame fins having outwardly opening slots for receiving a corner fin pin, said pin having a head spaced from said corner fin, said head being larger than said slot for locking said corner fin in place.

45. The structure of claim 44 wherein said frame fins include elongated openings extending parallel to the longitudinal axes of said frame fins and being connected to said slots receiving said pins whereby said corner fins are adjustable to matingly engage said corners of said window units.

46. The structure of claim 44 wherein said outwardly opening slots extend diagonally.

47. The structure of claim 45 wherein said pins have a size larger than the width of said slots and said frame fins are made of flexible material whereby said pins are snapped into said elongated openings from said connecting slots.

48. The structure of claim 28 wherein said fins are made of metal.

* * * * *